US006419351B1

(12) United States Patent
Lawson et al.

(10) Patent No.: US 6,419,351 B1
(45) Date of Patent: Jul. 16, 2002

(54) INK CARTRIDGE PLUNGER

(75) Inventors: Rebecca A. Lawson; James W. Lowry; Keith R. Rea, all of Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/916,814

(22) Filed: Jul. 27, 2001

(51) Int. Cl.[7] ..... B41J 27/75
(52) U.S. Cl. ..... 347/86
(58) Field of Search ..... 347/85, 86, 87; 222/327; 101/202

(56) References Cited

U.S. PATENT DOCUMENTS

| | | | | |
|---|---|---|---|---|
| 3,884,396 | A | 5/1975 | Gordon et al. | 222/327 |
| 4,269,330 | A | 5/1981 | Johnson | 222/386 |
| 4,331,267 | A | 5/1982 | Duncan et al. | 222/153.06 |
| 4,483,890 | A | 11/1984 | Beery et al. | 428/7 |
| 5,348,196 | A | 9/1994 | Smith et al. | 222/386 |
| 5,974,971 | A | 11/1999 | Möller et al. | 101/366 |
| 6,192,797 | B1 | 2/2001 | Rea et al. | 101/202 |

*Primary Examiner*—Anh T.N. Vo
(74) *Attorney, Agent, or Firm*—Bullwinkel Partners, Ltd.

(57) ABSTRACT

An improved plunger for a lithographic printing ink cartridge prevents air entrapment between the plunger and the ink when the plunger is pressed into the ink during cartridge assembly. The plunger bottom portion has a positive radius and a textured surface that facilitates the flow of air away from the center of the plunger toward the cartridge sidewall as the plunger is pressed into the ink.

2 Claims, 2 Drawing Sheets

INK CARTRIDGE PLUNGER

BACKGROUND

1. Field of the Invention

This patent relates to ink dispensing cartridges for automated dispensing systems, such as those used for lithographic printing presses. More specifically, this patent relates to an improved plunger for an ink-dispensing cartridge.

2. Description of the Related Art

Lithography is a printmaking process in which ink is applied to a plate having both image and non-image areas. The image areas are ink-receptive and water-repellent. The non-image areas are water-receptive and ink-repellent. In rotary type presses the plate is mounted on a cylinder that rotates during printing. In one typical configuration, the plate cylinder picks up the ink at the image areas and transfers the image to a blanket cylinder, which in turn transfers the image to the paper. In multi-color sheet-fed presses, up to ten inking stations can be placed in series. Each station has its own ink feeding system and handles a separate color. As the paper sheet moves from station to station, a new color is put down at each station.

Because lithographic ink is thixotropic and very viscous, conventional lithographic ink feeding systems require a complex system of drums, vibrators and fountain rollers. In a typical lithographic ink feeding system, workers remove lithographic ink from a drum (or, in some cases, smaller tins) with specially made spatulas and spread the ink across a tray (the ink fountain).

Storing lithographic ink in drums or tins can result in wasted ink if the entire drum or tin is not used because the ink is prone to oxidation and spoilage. Thus, in recent years, smaller cartridge-type ink dispensers have been developed for use in automated ink dispensing systems. These new ink cartridges can dispense ink by two different methods. The first (automated) method is with the ink cartridge mounted over the ink fountain or the fountain roller. The ink cartridge moves back and forth across the fountain, dispensing ink into the fountain or directly onto an ink form roller to provide an even consistent layer of ink. The second (manual) method is by the use of a "handgun." The ink cartridge is placed inside the handgun. The dispensing end of the cartridge is placed over the rollers and ink is dispensed when the trigger is depressed. Ink is directed into the fountain manually. With either method, because the ink is dispensed directly from the cartridge, oxidation and spoilage are reduced.

Typical lithographic ink cartridges, such as that disclosed in U.S. Pat. No. 6,192,797, incorporated herein by reference, comprise a hollow cylindrical body, a plunger and a dispensing fitment. The cylindrical body holds a supply of extrudable, highly viscous ink and has a dispensing end and a plunger end. The plunger end is sealed by the plunger which moves within the cylindrical body to extrude the ink when the plunger is forced toward the dispensing end by, for example, pneumatic pressure. The dispensing end is sealed with the dispensing fitment, which typically includes a nozzle for directing the flow of the ink.

Lithographic ink cartridges typically are filled by setting the cartridge, with the dispensing fitment attached, underneath an ink flow. The cartridges typically are filled to a predetermined weight, and then the plunger is inserted into the plunger end of the cartridge.

A disadvantage of conventional ink cartridges is that, during the ink filling process, air can get trapped between the plunger and the ink when the plunger is inserted into the cartridge and pressed against the ink. Air entrapment can cause the ink to "skin over", creating a skin of partly oxidized ink on top of the ink. This skin can plug the nozzle in the dispensing fitment, or cause printing "hickies", i.e., areas on a sheet without ink coverage.

Thus the primary object of the present invention is to provide a plunger that prevents air entrapment between the plunger and the surface of the ink.

Another object of the present invention is to provide a plunger and dispensing fitment that nest together to minimize unused ink.

Further and additional objects will appear from the description, accompanying drawings, and appended claims.

SUMMARY OF THE INVENTION

The present invention is an improved plunger for an ink cartridge such as those used with automated lithographic printing presses. The plunger has a bottom portion and a sidewall extending upward from the periphery of the bottom portion. The bottom portion has a positive radius. That is, when inserted into an ink-filled cartridge, the side of the bottom portion facing the ink is convex. The bottom portion also has a textured surface to define channels through which air can flow when the plunger comes into contact with the ink. The plunger's positive radius and textured surface facilitate the movement of air from the center of the plunger toward the cartridge body, thus minimizing air entrapment between the plunger and the ink.

THE DRAWINGS

DETAILED DESCRIPTION OF THE INVENTION

Figure 1:
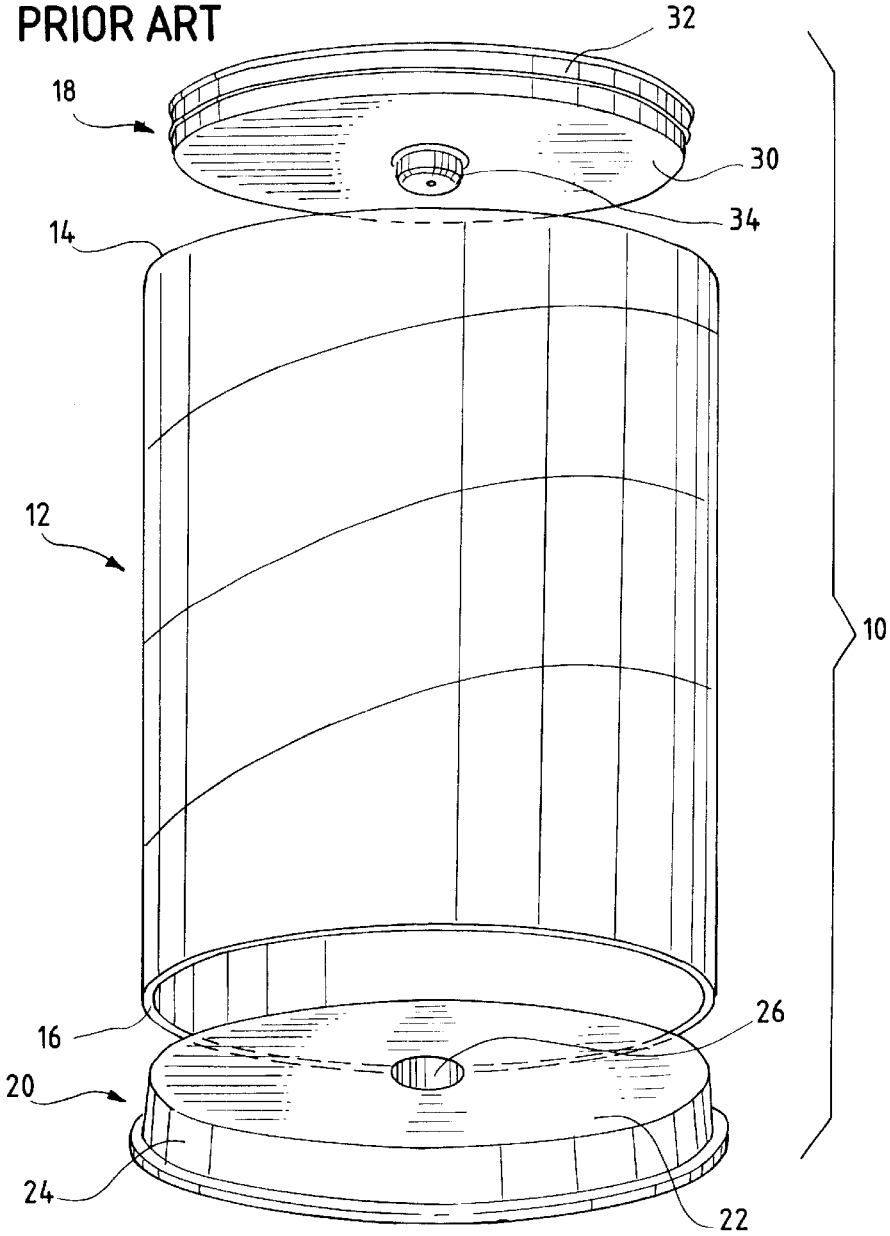
FIG. 1 PRIOR ART
FIG. 1 is an exploded perspective view of an ink cartridge having a conventional plunger.

Turning to the drawings, there is shown in FIG. 1 an exploded perspective view of an ink cartridge 10 equipped with a conventional plunger. The ink cartridge 10 comprises a hollow cylindrical body 12 having a plunger (top) end 14 and a dispensing (bottom) end 16, a plunger 18 inserted into the plunger end 14 for sliding engagement with the inside wall of the cartridge body 12, and a dispensing fitment 20 mounted in sealing engagement with the dispensing end 16 of the cartridge body 12. Typically, the dispensing fitment 20 is glued to the cartridge body 12.

The cartridge body 12 may be made of convolutely wound paper lined internally with polymeric material or it may be made with any other suitable materials such as metal or plastic. The plunger 18 and the dispensing fitment 20 are typically made of plastic. In practice, such ink cartridges are typically about nine or thirteen inches long, but they may be any suitable length, depending on need and the dimensions of the cartridge carrier.

The dispensing fitment 20 is generally cup-shaped and comprises a substantially circular disk 22 and an annular sidewall 24 formed around the periphery of the disk 22 and extending downwardly therefrom (down being defined as the direction toward the dispensing end 16). A nozzle (not shown) for controlling the flow of ink is mounted to the circular disk 22 over a centrally disposed aperture 26. The nozzle may be recessed inside the cup-shaped dispensing fitment 20 so that the cartridge 10 can stand on its dispensing end during shipping and storage.

The conventionally-designed plunger 18 comprises a substantially planar surface 30 and a sidewall 32 extending upward from the periphery of the planar surface 30. A centrally disposed hub 34 extends downward from the planar surface 30 and is shaped to nest within the dispensing fitment aperture 26 to minimize the volume of ink left in the cartridge 10 when the plunger 18 is forced against the dispensing fitment 20 and the ink is spent.

The cartridge 10 typically is filled by setting the cartridge, with the dispensing fitment 20 sealing the dispensing end 16, underneath an ink flow. After a predetermined weight or volume of ink fills the cartridge 10, the plunger 18 is inserted into the plunger end 14 until the plunger is flush against the surface of the ink.

Unfortunately, the conventional plunger 18 has a tendency to trap air inside the cartridge 10. After ink has been inserted into the cartridge 10, the planar surfaces A and B of the bottom 30 and hub 34 can trap air underneath the plunger 18 due to non-uniform contact with the ink. Portions of the bottom 30 and hub 34 of the plunger contact peaks of the ink, leaving "valleys" of air. The air does not have any channels through which to escape between the sidewall 32 of the plunger 18 and the cartridge body 12, and therefore stays trapped inside the cartridge 10. The ink in these areas will dry over time. If the dried ink is released from the cartridge 10, it can create printing defects such as hickies.

Figure 3:
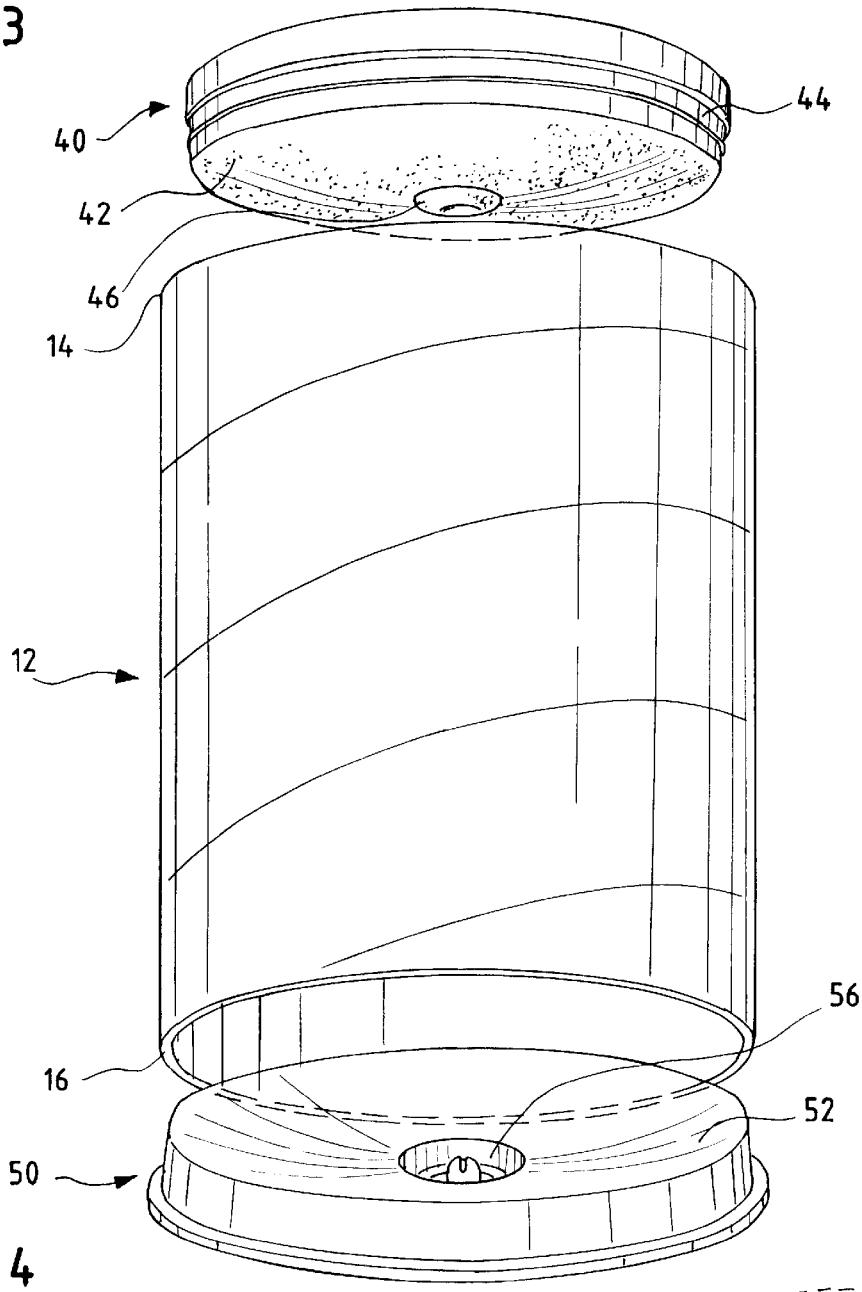
FIG. 3 is an exploded perspective view of an ink cartridge having a plunger according to the present invention.
Figure 4:
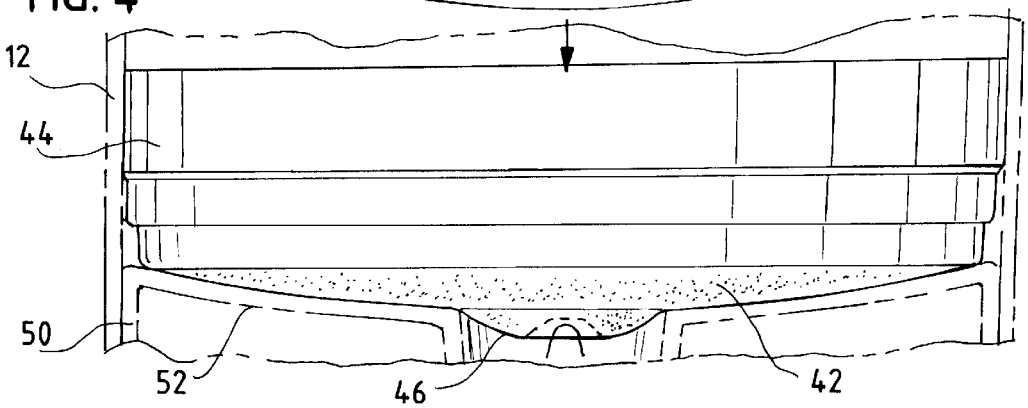
FIG. 4 is a side plan view of the plunger of FIG. 3, shown inserted into the cartridge body and nested against the dispensing fitment.

The problem of air entrapment can be minimized or eliminated by using the improved plunger of the present invention. As shown in FIGS. 3 and 4, the improved plunger 40 comprises a bottom portion 42 and a sidewall 44 extending upward from the periphery of the bottom portion 42. But the bottom portion 42, instead of being substantially flat (planar) as in the prior art plunger 18, has a positive radius. That is, when viewed from below (the side facing the ink), the bottom portion 42 is convex. The convex shape of the plunger bottom portion 42 facilitates the flow of air away from the center region 46 toward the cartridge body 12 when the plunger 40 is inserted into the filled cartridge and pressed against the ink.

In another aspect of the invention, incorporated into the convex bottom portion 42 is a means for channeling air outward from the center region 46 toward the cartridge body 12. Preferably, this channeling means is a textured surface. The bottom portion 42 may be textured with bumps, nubs, ridges, grooves or any other type of projection or indentation capable of defining channels through which air can flow when the plunger 40 comes into contact with the ink.

The plunger 40 works in the following manner. During the ink filling process, the plunger's positive radius allows the center region 46 to come into contact with the ink in the center of the cartridge first. Any air between the plunger 40 and the ink is then pressed to the sidewall 12 of the cartridge. The movement of air toward the sidewall 12 is assisted by the textured bottom surface 42. As the plunger 40 is pressed further into the ink, the air continually channels up the sides of the cartridge and out, significantly reducing or eliminating air entrapment.

Figure 2:
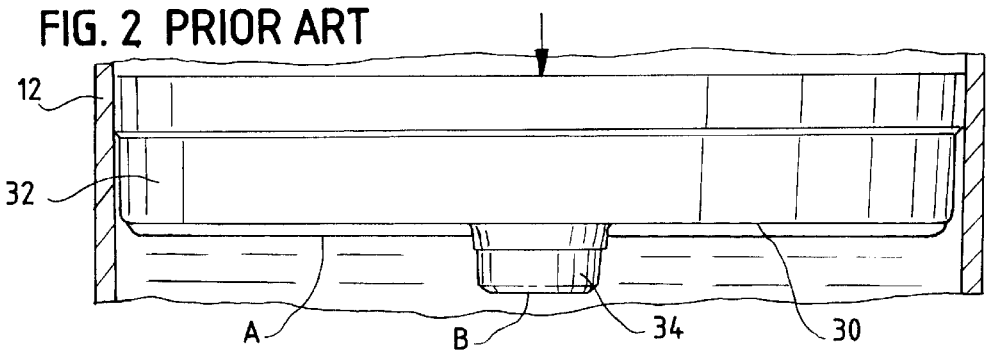
FIG. 2 PRIOR ART
FIG. 2 is a side plan view of the conventional plunger of FIG. 1, shown inserted into the cartridge body.

The channeling of air between the plunger sidewall 44 and the cartridge body 12 may be facilitated by a vent strip (not shown) placed between the plunger sidewall 44 and cartridge body 12 when the plunger 40 is inserted into the cartridge 10. With conventional plungers such as that shown in FIG. 2, this vent strip is not adequate to reach air pockets located away from the cartridge body 12. With the modified plunger 40, the vent strip is adequate, though not always required. Even without a vent strip the air can still escape between the plunger sidewall 44 and the cartridge body 12 if the plunger 40 is inserted at the slightest angle.

Preferably, the dispensing fitment 50 is shaped to nest with the plunger 40. That is, the dispensing fitment has a top surface 52 with a negative radius that nests with the positive radius of the plunger bottom surface 42, as shown in FIG. 4. The center region 46 of the plunger 40 may have an exaggerated convex curvature to better fit within the central aperture 56 of the dispensing fitment 50.

In the preferred embodiment, both the plunger 40 and the dispensing fitment 50 are molded from high-density polyethylene, although any suitable material may be used.

Other modifications and alternative embodiments of the invention are contemplated which do not depart from the spirit and scope of the invention as defined by the foregoing teachings and appended claims. It is intended that the claims cover all such modifications that fall within their scope.

We claim as our invention:

1. A plunger for a printing ink cartridge, the cartridge comprising a cylindrical body having a dispensing end and a plunger end and partially filled with extrudable ink, the dispensing end being sealed with a dispensing fitment, the plunger end being closed by the plunger, the plunger comprising:

an ink-contacting portion and a sidewall extending upward from the periphery of the ink-contacting portion, the ink-contacting portion having a textured, convex surface including means for channeling air outward from the center of the ink-contacting portion toward the cylindrical body when the ink-contacting portion is pressed against the ink inside the cartridge.

2. A printing ink cartridge comprising:

a hollow cylindrical body for holding a supply of extrudable ink, the cylindrical body having a dispensing end and a plunger end;

a plunger adapted to serve as a piston within the cylindrical body to extrude the ink when the plunger is forced toward the dispensing end, the plunger comprising a bottom portion and a sidewall extending upward from the periphery of the bottom portion, the bottom portion having a positive radius and a textured surface including means for channeling air outward from the center of the bottom portion toward the cylindrical body when the plunger is pressed into the ink inside the cartridge; and a dispensing fitment mounted in sealing engagement with the dispensing end of the cylindrical body, said dispensing fitment comprising a top portion having a negative radius for nesting with the plunger bottom portion.

* * * * *